United States Patent [19]

Hurmence

[11] 4,311,264

[45] Jan. 19, 1982

[54] GOLF CLUB CARRIERS

[76] Inventor: Howard H. Hurmence, 918 Avalon Dr., Statesville, N.C. 28677

[21] Appl. No.: 35,708

[22] Filed: May 3, 1979

[51] Int. Cl.[3] ..... A63B 55/00

[52] U.S. Cl. ..... 224/257; 150/1.5 B; 211/60 G

[58] Field of Search ..... 150/1.5 R, 1.5 B, 1.5 C; 224/202, 205, 207, 918, 257–268; 211/60 G

[56] References Cited

U.S. PATENT DOCUMENTS

| | | | |
|---|---|---|---|
| 2,419,175 | 4/1947 | Spohrer | 211/60 G |
| 2,480,597 | 8/1949 | Nelson | 211/60 G X |
| 2,791,255 | 5/1957 | Ogden | 150/1.5 R |
| 3,232,503 | 2/1966 | Thonen | 211/60 G X |
| 3,415,572 | 12/1968 | Zagwyn | 211/60 G X |
| 4,036,416 | 7/1977 | Lowe | 211/60 G X |
| 4,074,739 | 2/1978 | Rodeghier | 211/60 G X |

*Primary Examiner*—Stephen Marcus

[57] ABSTRACT

An improvement in non-bag golf club carriers in which clubs are kept positively separate from each other and held in place by gravity, without use of springs, clips or straps, made possible by incorporation of a partition on which suitable club supports are located, and by the described positioning of a handle and/or shoulder strap. A free-standing design of the carrier is described in which the legs are entirely out of the way of the person carrying the carrier. A feature of the carrier is that clubs are removed merely by lifting them off the supports.

7 Claims, 6 Drawing Figures

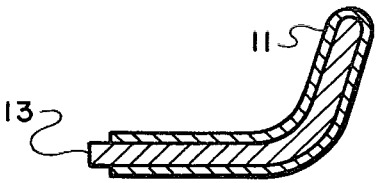
FIG. 2
FIG. 3
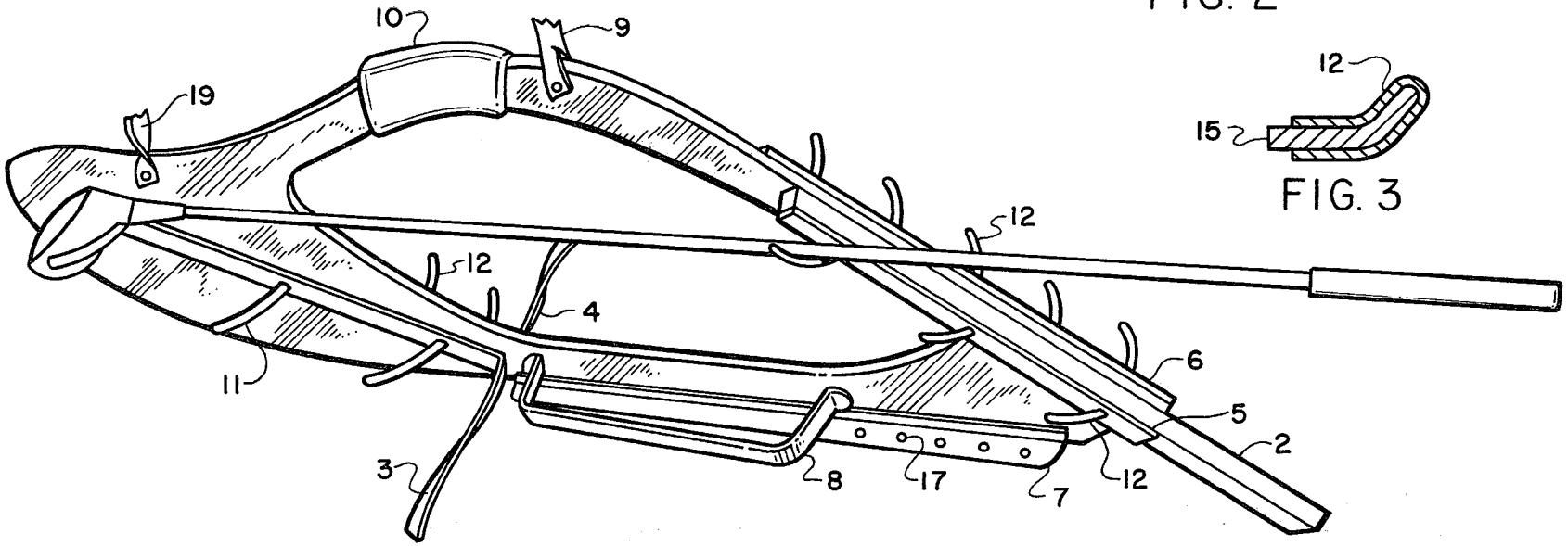
FIG. 1

GOLF CLUB CARRIERS

My invention relates to a device for carrying golf clubs during play. I intend use of the verb "carry" to mean transport of golf clubs directly by the person of the player as opposed to transport through use of wheels; and the word "carrier" to refer to a device, other than a conventional bag, for holding golf clubs to facilitate this purpose. Carriers are articles of commerce and their usefulness is established.

The principal feature of carriers is that they are light in weight to facilitate walking during play. Another common feature is that they keep the clubs separated from one another, though this feature is not universal and is accomplished with varying degrees of success. Another common feature, also not universal, is that they hold the clubs up off the ground when not being carried. My carrier possesses all these features to a superior degree, and has other advantages that will become apparent in this specification.

My carrier is unique principally, but not entirely, in that the clubs are held by gravity without springs or clips that rely on pressure to hold clubs in place; in that clubs are positively separated from each other by an esentially flat partition and by the suitable location of supports thereon; and in that my carrier is free-standing yet its legs in no way interfere with the player when walking. It is an object, with my carrier, that clubs cannot slide out of place nor be damaged either by striking against each other or by contact with devices that hold clubs in place by pressure, nor fail due to loss of tension in such club-holding devices. It is a further object that clubs can be easily removed from the carrier.

The best, but not the only, mode of carrying out my invention as contemplated by me is described in this specification.

Details of my invention are embodied in drawings shown on Sheets marked 1 and 2, incorporated as part of this specification. Different views are shown in drawings labeled FIGS. 1 through 6.

FIG. 1 is a composite view from a perspective showing as many parts of the carrier as feasible.

FIGS. 2 and 3 are full scale cross sections of suitable club supports.

FIG. 4 is a scaled down elevation of carrier, while

Figure 4:
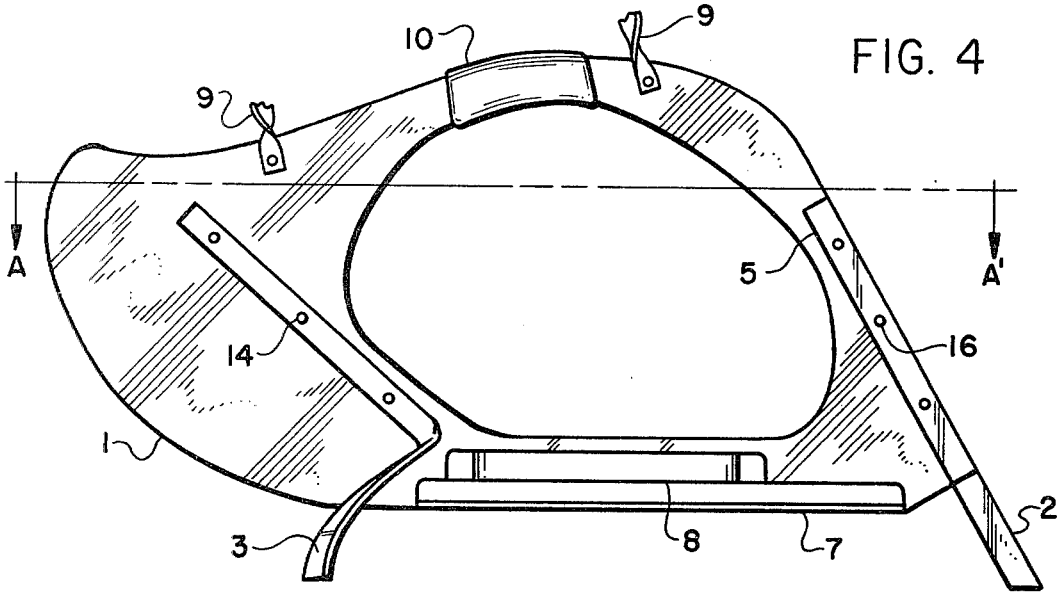

Fastening devices and holes for same are not shown in these drawings, as their type and location are not critical and showing them would complicate the drawings and serve no purpose. The various parts of the carrier can be fastened together by means of rivets, bolts or screws as will be readily envisioned. I prefer to use aluminum rivets throughout, except, as specifically mentioned later, in anchoring the club supports.

In FIG. 1, all parts of the carrier can be seen, except three of the type of club supports labeled 12 which are behind the left hand (front) end of the partition labeled 1. The overall dimensions of the carrier as shown are approximately 26 inches in length, 13 inches in height, and 10 inches in width. These dimensions are not critical to my invention. Item 1 is an essentially flat partition made of any light weight, water-resistant material of suitable strength. An important feature of this partition is that the club heads, not just the club shafts, rest upon it and are separated by it. For this part I prefer to use a panel made of $\frac{1}{4}$ inch thick waterproofed wood-plastic composite with the center cut out as shown to reduce weight. Item 2 is a straight rectangular bar which serves as a separator for the club shafts, as a structural stiffener, and as a rear leg for the carrier. I prefer to use wood for this part. Item 3 is a rectangular bar bent as shown both to provide one of the front legs of the carrier and to anchor the three club supports labeled 11. Item 4 is essentially a mirror-image of Item 3. It provides the second front leg and serves to anchor five club supports labeled 12, only two of which can be seen from this perspective, the other three being behind the partition. The manner of locating and shaping these two rectangular bars, which form the legs of my carrier, is a feature of my invention, as will be later described. I prefer to use $\frac{3}{4}$ inch by $\frac{1}{8}$ inch rectangular aluminum bar for both of these parts. Items 5 and 6 are straight rectangular bars serving to anchor club supports labeled 12 as shown. I prefer $\frac{3}{4}$ inch by $\frac{1}{8}$ inch thick rectangular aluminum bar for both these parts. Item 7 is a straight angle provided primarily for stiffness. I prefer $\frac{3}{4}$ inch by $\frac{3}{4}$ inch by 1/16 inch aluminum angle for this part. The holes labeled 17 are drilled or punched in this part to hold golf tees and are only incidental to my invention. Item 8 is a golf ball holder, also incidental, designed to hold four golf balls. Balls which are placed inside the confines of this frame rest on the angle labeled 7. I prefer to use $\frac{3}{4}$ inch by 1/16 inch rectangular aluminum bar for this part. Item 9 is a shoulder strap approximately 40 inches long and $1\frac{1}{8}$ inches wide. A portion of this strap is shown at each point of attachment. It can readily be visualized that these two portions are connected to form a continuous shoulder strap. These points of attachment are an important feature of my invention, as will be later described. Any strong, flexible material may be used for this strap; I prefer to use leather. Item 10 is a carrying handle fastened over the $\frac{1}{4}$ inch thick partition to form a thicker and hence more comfortable grip. The positioning of this handle is also a feature of my invention, as will be later described. I prefer to make this carrying handle of wood. Items labeled 11, of which there are three, are used for supporting the heads of wood clubs. Items labeled 12, of which there are thirteen, are used to support the heads of iron clubs and the shafts of all clubs.

In use, still referring to FIG. 1, each golf club is placed on two corresponding supports horizontal to each other, with the club heads on the curved left hand (hereafter called the front) end of the carrier, with the club shafts parallel to each other and horizontal to the ground. Woods are placed on the facing side, the heads seating into club supports labeled 11 and the shafts resting on supports labeled 12. A putter and four iron clubs are placed on the club supports labeled 12 on the reverse side of my carrier, again with the club heads at the front end, and with the club shafts parallel to each other and horizontal to the ground. When the carrier is loaded, the club heads are directly across the partition from each other and separated by it. The club heads actually rest against the partition, which unique feature contributes to the stability of the carrying system.

Although the club shafts are horizontal when the carrier is resting on the ground, both the shoulder strap and the carrying handle are so positioned that, when the carrier is lifted, the club shafts assume a downward slope and gravity, during the vibration and motion of walking, causes the club heads to seat into the supports. To accomplish this, the points of attachment of the shoulder strap to the partition must be so located that, when the fully-loaded carrier is freely hung from the strap's midpoint, the shafts of the clubs will slope downward from head to grip at an angle of at least 10 degrees and not more than 45 degrees from the horizontal. If the slope angle is greater than 45 degrees, the grips of the clubs are likely to strike the ground during lifting or setting the carrier down. I prefer that this angle of downward slope be between 15 and 20 degrees. Likewise, the carrying handle should be so positioned that, when the fully-loaded carrier is freely supported at the handle's midpoint, the shafts of the clubs will slope downward from head to grip at an angle of at least 10 degrees and not more than 45 degrees. Again, I prefer that this angle of downward slope be between 15 and 20 degrees. It is obvious that when the position of the club supports or other features of my design are changed, the location of the strap attachments and the handle must be changed to maintain the downward slope of the shafts as specified. I prefer to use leather for the shoulder strap and wood for the carrying handle.

The downward slope angle that pertains when the fully-loaded carrier is freely suspended from the midpoints of the shoulder strap or carrying handle is somewhat smaller than the downward slope angle that will pertain in actual use. This is due to the construction of the human hand and the fact that the shoulder strap is naturally picked up and placed on the shoulder ahead of its midpoint.

A club is removed from my carrier merely by grasping the shaft and lifting it off its supports. This is a distinct advantage over other carriers, where the clubs are held either by springs, clips or straps.

Another important feature of my invention involves the front two legs of my carrier. These legs are deliberately angled toward the front of the carrier. This feature is most clearly shown in FIG. 5. Angling the legs toward the front, plus the fact that said legs tilt up and forward when the carrier is lifted, puts the legs out of the way of the person walking with the carrier. I know of no other free-standing carrier where the legs in no way interfere with walking. These front legs must be angled forward to the extent that the acute angle formed between each of the legs and the line of the club shafts is not more than 60 degrees and not less than 30 degrees. An angle greater then 60 degrees is ineffective, and construction becomes impractical when this angle becomes less than 30 degrees. I prefer to use an angle of approximately 45 degrees to best accomplish my purpose.

FIGS. 2 and 3 are full scale longitudinal cross sections of club supports for wood and iron clubs respectively. Transverse cross sections, not shown, are circular. The inner cores, labeled 13 and 15, are metal, and the outer coverings are any soft material that will cushion the clubs. I prefer to use aluminum or brass rod for the cores, and chloroprene rubber for the coverings. The shape, positioning, and spacing of these supports is not critical to my invention and can be arrived at by trial and error. The requirements are that the club heads seat firmly, that the clubs do not touch each other, and that each club may be easily removed. Supports of other shapes and positions could be used within the scope of my invention. Fewer or more supports could also be used.

Figure 5:
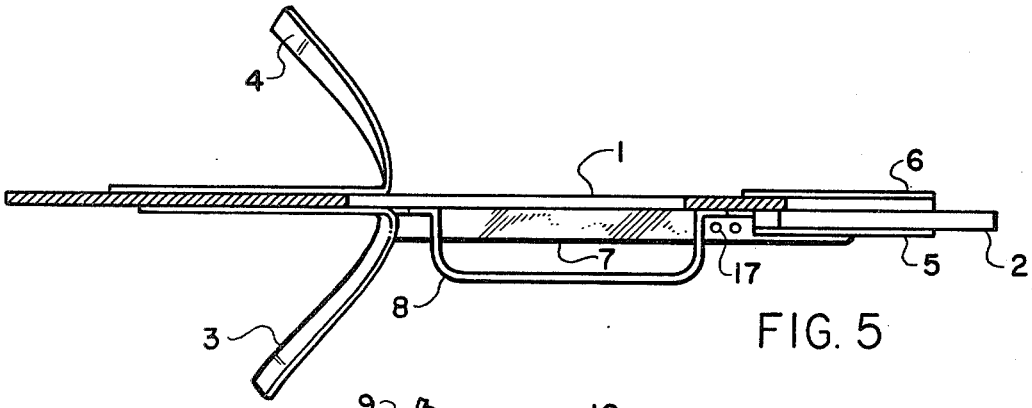
FIG. 5 is the plan view, sectioned as shown for clarity.
Figure 6:
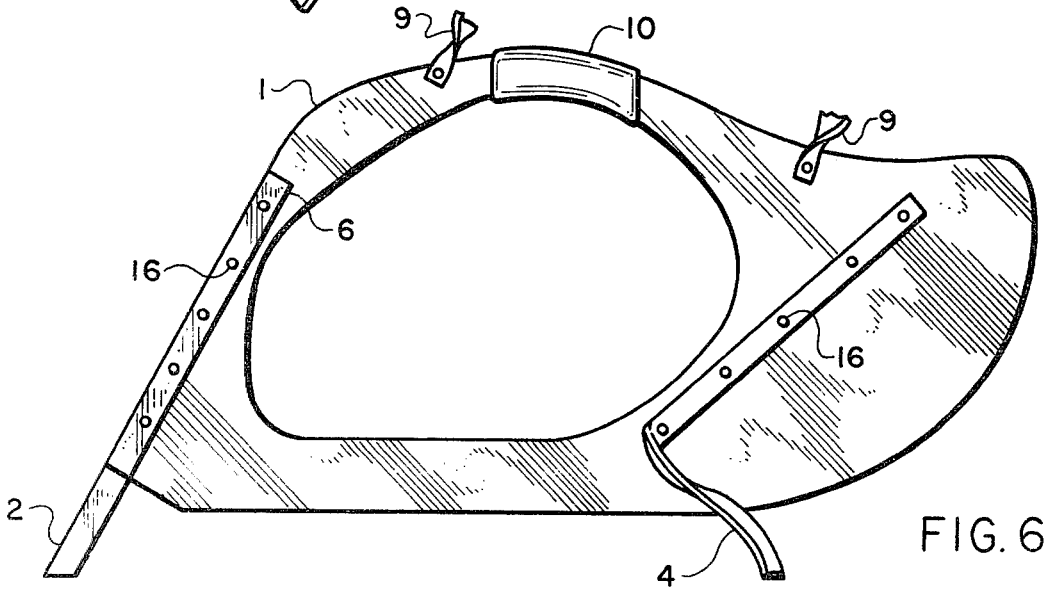
FIG. 6 is an elevation of the reverse side of the carrier to that shown in FIG. 4.

FIGS. 4, 5 and 6 show the true shape of my carrier as envisioned by me. FIG. 4 is an elevation drawn to scale. FIG. 5 is Section A–A′ of FIG. 4, this section being chosen to eliminate the complication of the handle and shoulder strap in the plan view. FIG. 6 shows the reverse side of FIG. 4. Items labeled 14 are three holes drilled or punched to anchor club supports labeled 11 and shown in FIG. 2. Items labeled 16 are thirteen holds to anchor the club supports labeled 12 and shown in FIG. 3. The metal cores of club supports can be swaged, welded, or screwed into these holes. I prefer that they be swaged.

The foregoing specification applies to right-handed golf clubs. To accommodate left-handed clubs, my carrier is built in mirror image.

In view of the novel and useful innovations herein described, I claim:

1. A carrier for a plurality of golf clubs, said carrier comprising: an essentially planar partition element having opposing face surfaces bounded by upper, lower, front and back edges, a plurality of golf club supports extending outwardly from at least one of said opposing face surfaces, each of said golf club supports comprising first means for supporting the head of a golf club adjacent said front edge, and second means for supporting the shaft of said golf club adjacent said back edge, means for carrying said carrier, said means for carrying and said first and second means being related so that when said carrier is carried each golf club head is seated in its respective first means and rests against said one of said opposing face surfaces, whereby each of said golf clubs is spaced from adjacent golf clubs.

2. A carrier as in claim 1 wherein said carrying means and said first and second means are further related so that when said carrier is carried, said golf clubs angle downwardly from head to grip.

3. A carrier as in claim 1 or claim 2 wherein said carrier means comprises an aperture cut from said essentially planar partition element.

4. A carrier as in claim 1 or claim 2 wherein said carrier means comprises a strap affixed to said essentially planar partition element.

5. A carrier as in claim 1 further comprising a plurality of golf club supports extending outwardly from the other of said opposing face surfaces.

6. A carrier as in claim 1 or claim 5 further comprising three legs attached to said essentially planar partition element, one of said legs being adjacent said rear edge and extending essentially in the plane of said essentially planar partition element, the others of said legs being adjacent said forward edge and being angled towards said forward edge so that when said carrier is supported on said three legs, the golf clubs will be horizontal.

7. A carrier as in claim 1, wherein said first and second means are shaped so that a golf club is inserted and removed therefrom by movement away from and toward, respectively, said upper edge.

* * * * *